US010500431B2

(12) United States Patent
Leier

(10) Patent No.: US 10,500,431 B2
(45) Date of Patent: Dec. 10, 2019

(54) EXERCISE DEVICE

(71) Applicant: Expectations, LLC, Puyallup, WA (US)

(72) Inventor: Christopher H. Leier, Lake Tapps, WA (US)

(73) Assignee: Expectations, LLC, Buckley, WA (US)

( * ) Notice: Subject to any disclaimer, the term of this patent is extended or adjusted under 35 U.S.C. 154(b) by 98 days.

(21) Appl. No.: 15/720,211

(22) Filed: Sep. 29, 2017

(65) Prior Publication Data

US 2018/0085614 A1 Mar. 29, 2018

Related U.S. Application Data

(60) Provisional application No. 62/401,254, filed on Sep. 29, 2016.

(51) Int. Cl.
*A63B 21/002* (2006.01)
*A63B 21/00* (2006.01)
*A63B 23/00* (2006.01)

(52) U.S. Cl.
CPC ..... *A63B 21/0023* (2013.01); *A63B 21/4035* (2015.10); *A63B 2023/006* (2013.01); *A63B 2208/0233* (2013.01); *A63B 2210/50* (2013.01)

(58) Field of Classification Search
CPC ..... A63B 21/0023; A63B 21/00185; A63B 23/12; A63B 23/0233; A63B 21/068; A63B 2210/50; A63B 2208/0233; A63B 2023/006; A63B 21/4035; A61H 1/0292; A61H 2201/1261; A61H 2203/0431
See application file for complete search history.

(56) References Cited

U.S. PATENT DOCUMENTS 4,566,693 A * 1/1986 Seidentop ..... A61H 1/0218 482/144
5,135,459 A * 8/1992 Perry, Jr. ..... A63B 21/00047 482/144
5,203,755 A * 4/1993 Kaiser ..... A61H 1/0218 482/142
5,232,425 A * 8/1993 Miller ..... A63B 21/0004 482/121
5,295,936 A * 3/1994 Perry, Jr. ..... A63B 21/00047 482/134

(Continued)

OTHER PUBLICATIONS

International Search Report, dated Dec. 26, 2017.

*Primary Examiner* — Garrett K Atkinson
(74) *Attorney, Agent, or Firm* — Dicke, Billig & Czaja, PLLC

(57) ABSTRACT

The current document is directed to an improved exercise device that facilitates isometric back-stretching exercises and other isometric exercises. One implementation of the improved exercise device includes a tubular U-shaped frame to which two conforming thigh pads are rotatably and slidably mounted. In this implementation, a tubular T-shaped extension is removably attached to the U-shaped frame to provide two leg pads mounted to a crossbar member of the T-shaped extension. The plane of the U-shaped frame is inclined with respect to the plane of the T-shaped extension. The U-shaped frame includes two handles at each end, each handle comprising a tubular handgrip that fits over the ends of the U-shaped frame.

20 Claims, 4 Drawing Sheets

(56) References Cited

U.S. PATENT DOCUMENTS 5,637,066 A * 6/1997 Chang ..... A63B 21/0004 482/121
5,759,138 A * 6/1998 Boland ..... A63B 23/0211 482/122
5,816,985 A * 10/1998 Ho ..... A63B 21/0004 482/140
5,941,806 A * 8/1999 Olschansky ..... A63B 23/0222 482/132
6,056,676 A * 5/2000 Adams ..... A63B 21/0004 482/112
6,090,023 A * 7/2000 Liu ..... A63B 21/0004 482/130
6,220,995 B1 * 4/2001 Chen ..... A63B 21/02 297/175
6,296,598 B1 * 10/2001 Boland ..... A63B 21/0004 482/126
6,443,879 B1 * 9/2002 Chen ..... A61H 1/0218 482/143
D463,837 S * 10/2002 Tuller ..... D21/662
6,458,062 B2 * 10/2002 Conner ..... A63B 21/0552 482/129
6,494,819 B1 * 12/2002 Boland ..... A63B 21/023 482/121
6,939,277 B2 * 9/2005 Tuller ..... A63B 21/026 482/126
7,282,014 B2 * 10/2007 Krietzman ..... A63B 21/0603 482/114
7,641,595 B2 * 1/2010 Sharps ..... A63B 21/0608 473/276
7,699,763 B2 * 4/2010 Perry, Jr. ..... A61H 1/0218 482/142
8,764,617 B2 * 7/2014 Teeter ..... A61H 1/0292 482/126
8,790,227 B2 * 7/2014 Meister ..... A63B 23/0494 482/140
8,905,952 B2 * 12/2014 Berthiaume ..... A61H 1/0218 601/134
9,238,157 B2 * 1/2016 Chuang ..... A63B 21/00069
9,480,872 B2 * 11/2016 Attalah ..... A63B 21/05
9,713,740 B1 * 7/2017 Chen ..... A63B 23/0211
9,868,024 B2 * 1/2018 Castelluccio ..... A63B 23/0211
D818,548 S * 5/2018 Ho ..... D21/688
9,962,310 B1 * 5/2018 Wright ..... A61H 1/006
10,123,930 B2 * 11/2018 McBride ..... A61H 1/0229
2007/0281840 A1 * 12/2007 Tsai ..... A63B 23/0211 482/140

* cited by examiner

EXERCISE DEVICE

CROSS-REFERENCE TO RELATED APPLICATION

The present application claims the benefit of U.S. Patent Provisional Patent Application No. 62/401,254, filed Sep. 29, 2016.

TECHNICAL FIELD

The current document is directed to personal exercise equipment and, in particular, to an exercise device that can be used for back-stretching exercises and various types of isometric exercises.

BACKGROUND

A variety of different types of exercise devices have been developed and manufactured to assist individuals in performing a variety of different types of isometric exercises, including back-stretching exercises. One such exercise device includes 2 U-shaped bars. A first larger U-shaped bar includes a central cylindrical leg pad. A second U-shaped bar includes two cylindrical leg pads and is rigidly affixed to the first U-shaped bar so that the plane of the second U-shaped bar is nearly perpendicular to the plane of the first U-shaped bar. This currently available exercise device is useful for isometric back-stretching exercises that can relieve lower back pain. However, this exercise device is relatively expensive to manufacture, is somewhat bulky and difficult to maneuver and manipulate, and requires relatively large-volume packaging for shipping and distribution.

SUMMARY

The current document is directed to an improved exercise device that facilitates isometric back-stretching exercises and other isometric exercises. One implementation of the improved exercise device includes a tubular U-shaped frame to which two conforming thigh pads are rotatably and slidably mounted. In this implementation, a tubular T-shaped extension is removably attached to the U-shaped frame to provide two leg pads mounted to a crossbar member of the T-shaped extension. The plane of the U-shaped frame is inclined with respect to the plane of the T-shaped extension. The U-shaped frame includes two handles at each end, each handle comprising a tubular handgrip that fits over the ends of the U-shaped frame.

DETAILED DESCRIPTION

Figure 1:
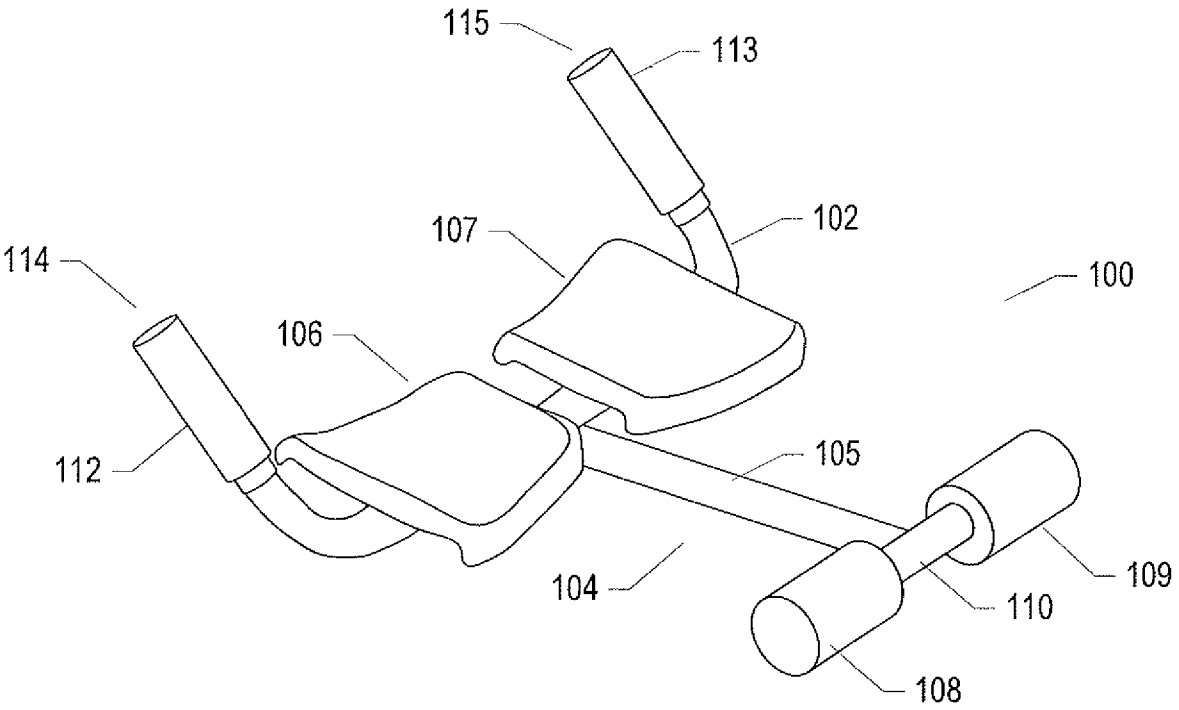
FIG. 1 provides a perspective view of one implementation of the currently disclosed exercise device.

FIG. 1 provides a perspective view of one implementation of the currently disclosed exercise device. In the implementation shown in FIG. 1, the exercise device 100 includes a U-shaped frame 102 and a T-shaped extension 104 that includes a shaft member 105 removably mounted to the U-shaped frame 102. In the implementation shown in FIG. 1, both the U-shaped frame and the T-shaped extension are manufactured from hollow, tubular or cylindrical bars. The hollow, tubular bars may be composed of metal, composite materials, or other stiff and rigid materials that can tolerate applied mechanical forces and internal stresses resulting from applied forces without bending, breaking, or permanent deformation. Two conforming thigh pads 106-107 are rotatably and slidably mounted to the U-shaped frame. Two cylindrical leg pads 108-109 are mounted over the two ends of a crossbar member 110 of the T-shaped extension 104. Two hand grips 112-113 are mounted over the two ends 114-115 of the U-shaped frame 102.

Figure 2:
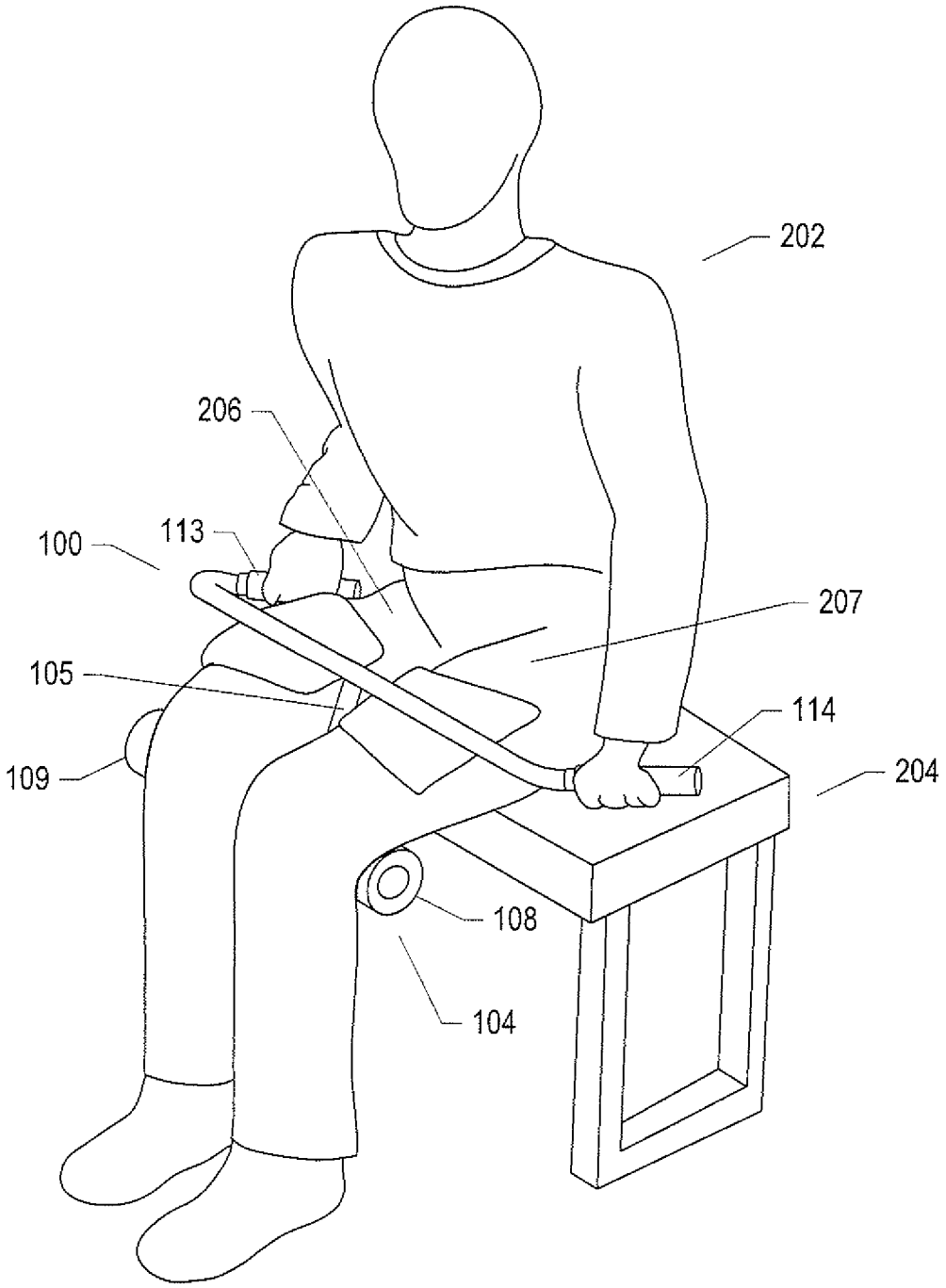
FIG. 2 illustrates an example isometric back-stretching exercise facilitated by the currently disclosed exercise device.

FIG. 2 illustrates an example isometric back-stretching exercise facilitated by the currently disclosed exercise device. In this exercise, a user 202 sits on a bench 204 with the exercise device 100 resting on the user's thighs 206-207 and with the shaft member 105 of the T-shaped extension 104 between the user's legs so that the leg pads 108 and 109 provide surfaces that contact the backs of the user's knees. By exerting forces downward through the handles 113-114, the user is able to stretch the user's lower back, with the exercise device helping to maintain the user in a sitting or chair-like posture.

Figure 3:
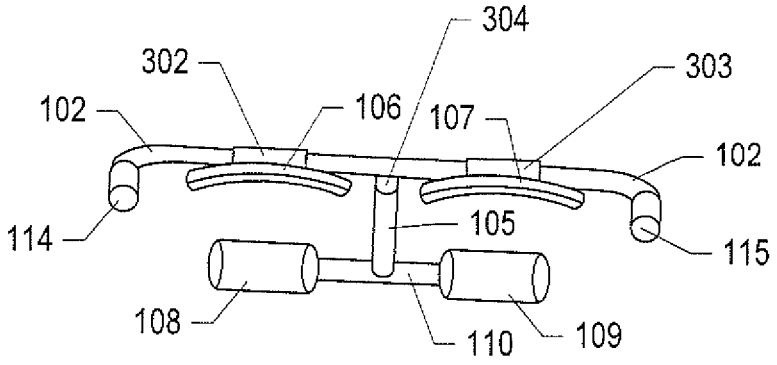
FIG. 3 shows one implementations of the currently disclosed exercise device from a second viewpoint.

FIG. 3 shows one implementations of the currently disclosed exercise device from a second viewpoint. In FIG. 3, the thigh pads 106-107 are seen to be mounted to the U-shaped frame by mounting devices 302-303. In one implementation, the mounting devices are C-shaped clips that can slide in both directions along the U-shaped frame 102 and that can additionally rotate about the U-shaped frame. Also visible in FIG. 3 is a short tubular stem 304 affixed to, or part of, the U-shaped frame and that is perpendicular or nearly perpendicular to the central portion of the U-shaped frame 102. The short tubular stem 304 serves as a mount for the T-shaped extension. In one implementation, the end of the short tubular stem is swedged or otherwise shaped to have a smaller outside diameter than the inner diameter of the shaft member 105 of the T-shaped extension, allowing the short tubular stem to be inserted into the shaft member of the T-shaped extension. In many implementations, one or more additional components are used to lock or secure the shaft member of the T-shaped extension in a fixed rotational and translational position relative to the short tubular stem so that the U-shaped frame 102 and the T-shaped extension together form a rigid exercise device. The T-shaped extension can be removed from the short tubular stem 304 to facilitate packing, shipping, and storing the exercise device. The shaft member 105 of the T-shaped extension is mounted to the crossbar member 110 by welding, brackets, and/or other rigid mounting methods and devices.

Figure 4:
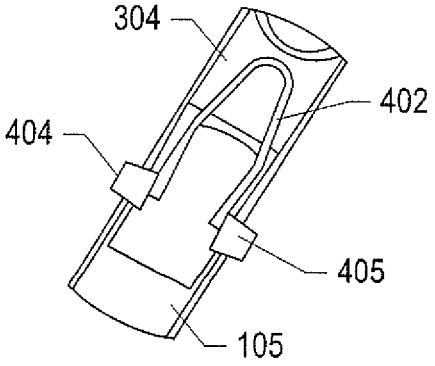
FIG. 4 illustrates components used in one implementation for securing or locking the position of the shaft member 105 of the T-shaped extension with respect to the short tubular stem 304 of the U-shaped frame 102.

FIG. 4 illustrates components used in one implementation for securing or locking the position of the shaft member 105 of the T-shaped extension with respect to the short tubular stem 304 of the U-shaped frame 102. A snap-button fastener 402 is mounted within the short tubular stem 304 to provide spring-like extension of two rounded buttons 404-405 that project outward through aligned apertures in the short tubular stem and the shaft member 105 of the T-shaped extension 104 to lock the translational and rotational position of the shaft member with respect to the short tubular stem.

Figure 5:
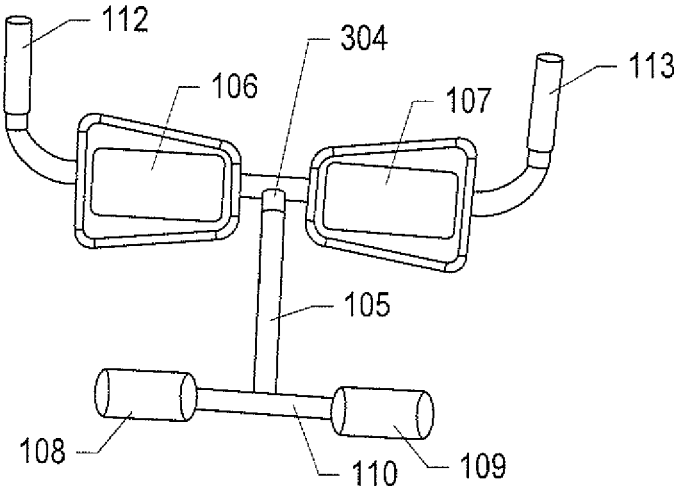
FIG. 5 shows yet another view of the currently disclosed exercise device.

FIG. 5 shows yet another view of the currently disclosed exercise device. In one implementation, the two leg pads 108-109 are cylindrical foam tubes affixed to the crossbar member 110 of the T-shaped extension by friction fit, adhesives, mounting rings, tape, or by other such securing methods. The crossbar member 110 and leg pads 108 and 109 together comprise left-hand and right-hand leg braces. In an alternative implementation, the end of the shaft member 105 of the T-shaped extension may have a smaller diameter than the inner diameter of the short tubular stem 304 so that the shaft member fits inside the short tubular stem, with the snap-button fastener mounted within the shaft member.

Figure 6:
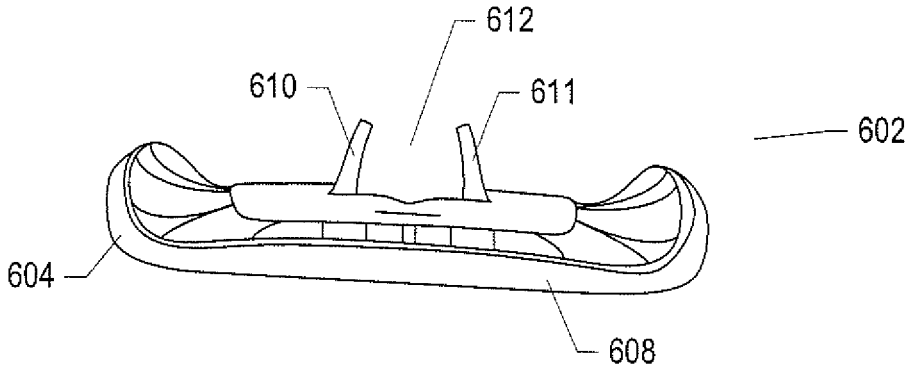
FIG. 6 shows one of the two leg pads.

FIG. 6 shows one of the two thigh pads. The thigh pad 602 includes a base 604. In one implementation, the base is an injection-molded plastic base. A rectangular cavity in the outer surface of the thigh pad accommodates a rectangular insert 608. The rectangular insert may be secured within the cavity by snap-fit clips, screws, or other types of fastening devices. The rectangular insert, in one implementation, is a rectangular foam pad with a rigid or semi-rigid substrate or backing. The rectangular foam pad conforms to the surface of a user's thighs and cushions the user's thighs when forces are applied to the exercise device. Two semi-cylindrical prongs 610 and 611 extend outward from the molded base to form a C-clip that securely, slidably, and rotationally amounts the thigh pad to the U-shaped frame, a portion of which lies within the cylindrical space 612 between the two prongs 610-611. The two prongs can be temporarily deformed to fit over the U-shaped frame, but immediately return to their original shape and configuration to securely mount the thigh pad to the U-shaped frame.

The present invention has been described in terms of particular embodiments, it is not intended that the invention be limited to these embodiments. Modifications within the spirit of the invention will be apparent to those skilled in the art. For example, components of the currently disclosed exercise device can be manufactured from many different types of materials, including metals, composites, plastics, and even natural fibrous materials. The handgrips, thigh-pad inserts, and leg pads can be manufactured from a variety of different materials, including open-cell and closed-cell foams, pliable polymeric materials, and natural materials. The dimensions of the currently disclosed exercise device may vary in different implementations. In certain implementations, additional dimensional flexibility can be provided by using an adjustable-length U-shaped frame member and/or an adjustable-length T-shaped extension. The shapes, curvature, and dimensions of the various components of the exercise device may vary with different implementations. In certain implementations, additional flexibility in the configuration of the currently disclosed exercise device may be provided by additional configurable fittings and joiners. In certain implementations, a single thigh pad may span both of a user's legs and/or a single leg pad may span both of a user's legs.

The invention claimed is:

1. An exercise device comprising:

a U-shaped frame that includes two handles and onto which two thigh pads are mounted between the two handles, the U-shaped frame configured and arranged to extend across a user's thighs and proximate a user's hips thereby positioning the thigh pads on top of the user's thighs and the handles proximate the user's hips during use; and a T-shaped extension, affixed to the U-shaped frame between the two thigh pads, that includes two leg pads extending outward therefrom, the T-shaped extension configured and arranged to extend between a user's legs thereby positioning the two leg pads proximate backs of a user's knees during use.

2. The exercise device of claim 1 wherein the U-shaped frame further comprises a U-shaped, hollow, tubular bar to each end of which hand grips are mounted.

3. The exercise device of claim 1 wherein the T-shaped extension further comprises a shaft member that is removably affixed to the U-shaped frame at a first end and that is affixed to a crossbar member at a second end.

4. The exercise device of claim 3 wherein the shaft member and the cross bar member are both hollow, tubular bars.

5. The exercise device of claim 3 wherein the leg pads are cylindrical foam pads mounted to the ends of the crossbar member by one or more of friction fit;

an adhesive;

mounting rings; and tape.

6. The exercise device of claim 3 wherein the U-shaped frame additionally includes a short tubular stem, mounted perpendicularly to, or formed as part of, the U-shaped frame; and wherein a first end of the shaft member of the T-shaped extension removably mounts to the short tubular stem.

7. The exercise device of claim 6 wherein the stem includes a snap-button fastener that provides spring-like extension of two rounded buttons that project outward through aligned apertures in the stem and the shaft member of the T-shaped extension when the stem is inserted into the shaft member of the T-shaped extension, to secure the rotational and translation position of the T-shaped extension with respect to the stem.

8. The exercise device of claim 6 wherein the shaft member of the T-shaped extension includes a snap-button fastener that provides spring-like extension of two rounded buttons that project outward through aligned apertures in the stem and the shaft member of the T-shaped extension when the shaft member of the T-shaped extension is inserted into the stem, to secure the rotational and translation position of the T-shaped extension with respect to the stem.

9. The exercise device of claim 1 wherein the thigh pads each comprises:

a molded base;

a cavity that accommodates an insert; and a mounting component that slidably and rotationally mounts the thigh pad to the U-shaped frame.

10. The exercise device of claim 9 wherein the base is injection-molded plastic.

11. The exercise device of claim 9 wherein the mounting component comprises two semi-cylindrical prongs affixed to, or molded as part of, the molded base.

12. The exercise device of claim 9 wherein the insert comprises a compliant material selected from the group consisting of:

open-cell foam;

closed-cell foam;

a pliable polymeric material; and at least one natural pliable material.

13. An exercise device comprising:

a U-shaped frame that includes two handles;

two thigh pads rotationally and slidably mounted to the U-shaped frame, the two thigh pads configured and arranged to be positioned on top of a user's thighs during use; and a T-shaped extension, removably affixed to the U-shaped frame between the two thigh pads, that includes two leg pads extending outward therefrom, the T-shaped extension configured and arranged to extend between a user's legs during use thereby positioning the two leg pads proximate backs of a user's knees.

14. The exercise device of claim 13 wherein the U-shaped frame further includes a stem that is affixed to, or formed as part of, the center of the U-shaped frame, the stem serving as a mount for the T-shaped extension;

wherein a first thigh pad is rotationally and slidably mounted on a portion of the U-shaped frame extending in a first direction from the stem; and wherein a second thigh pad is rotationally and slidably mounted on a portion of the U-shaped frame extending in a second direction from the stem.

15. The exercise device of claim 13 wherein the T-shaped extension further comprises:

a shaft member, a first end of which mounts to the stem and extends perpendicularly from a central portion of the U-shaped frame;

a crossbar member, affixed to a second end of the shaft member and perpendicularly disposed to the shaft member;

a first leg pad of the two leg pads mounted to a first portion of the crossbar member; and a second leg pad of the two leg pads mounted to a second portion of the crossbar member.

16. An exercise device comprising:

a rigid frame that is reversibly assembled from first and second components and disassembled into first and second components;

two hand grips mounted to the first component of the frigid frame;

two hand grips mounted to the first component of the rigid frame;

one or more thigh pads mounted to the first component of the rigid frame between the two hand grips; and one or more leg pads mounted to the second components of the rigid frame;

wherein the two hand grips, one or more thigh pads, and one or more leg pads are mounted in positions so that, when a user employs the exercise device during an isometric exercise, the second component extends between legs of the user, the one or more thigh pads cushion one or more thigh of the user while the one or more leg pads fit against the back side of one or more legs of the user while the user applies a force to the handles through arms and hands of the user, with upper legs perpendicular to back and lower legs of the user.

17. The exercise device of claim 16 wherein the first component includes a U-shaped-frame component and the second components includes a T-shaped-extension component.

18. The exercise device of claim 17 wherein a first hand grip is mounted to a first end of the U-shaped-frame component and wherein a second hand grip is mounted to a second end of the U-shaped-frame component.

19. The exercise device of claim 17 wherein a first thigh pad is mounted to a first portion of a central portion of the U-shaped-frame component and wherein a second thigh pad is mounted a second portion of the central portion of the U-shaped-frame component.

20. The exercise device of claim 17 wherein a first leg pad is mounted to a first portion of a crossbar member of the T-shaped-extension component and wherein a second leg pad is mounted to a second portion of the crossbar member of the T-shaped-extension component.

* * * * *